United States Patent [19]

Yamatsuta et al.

[11] 4,452,865

[45] Jun. 5, 1984

[54] PROCESS FOR PRODUCING FIBER-REINFORCED METAL COMPOSITE MATERIAL

[75] Inventors: Kohji Yamatsuta, Otsu; Ken-ichi Nishio, Shiga, both of Japan

[73] Assignee: Sumitomo Chemical Company, Limited, Osaka, Japan

[21] Appl. No.: 446,048

[22] Filed: Dec. 1, 1982

[30] Foreign Application Priority Data

Dec. 2, 1981 [JP] Japan ..... 56-194127
Jul. 26, 1982 [JP] Japan ..... 57-130633

[51] Int. Cl.[3] ..... C22F 1/04

[52] U.S. Cl. ..... 428/614; 148/3; 148/11.5 Q; 148/437; 420/590

[58] Field of Search ..... 148/3, 11.5 Q, 404, 148/437, 11.5 A; 420/528, 590; 428/614

[56] References Cited

U.S. PATENT DOCUMENTS 3,853,635 12/1974 Demendi ..... 148/3
3,948,650 4/1976 Flemings et al. ..... 420/590
4,152,149 5/1979 Horikiri et al. ..... 148/437

*Primary Examiner*—L. Dewayne Rutledge
*Assistant Examiner*—Robert L. McDowell
*Attorney, Agent, or Firm*—Birch, Stewart, Kolasch & Birch

[57] ABSTRACT

A process for producing a fiber-reinforced metal composite material which comprises mixing an inorganic fiber with an aluminum alloy at a temperature of not lower than the melting point of said alloy to form a composite, (1) removing the composite from the mold at a temperature of not higher than the solid phase line of said alloy (i.e. a temperature at which a liquid phase appears in said alloy) and heating the composite to a temperature of more than the solid phase line and holding the temperature (heat treatment) during a definite time (Indirect method), or (2) without allowing to cool the composite to a temperature of not higher than the solid phase line (Direct method), quenching the composite to a temperature of 200° C. or lower from a temperature of higher than the solid phase line but lower than the melting temperature.

16 Claims, No Drawings

PROCESS FOR PRODUCING FIBER-REINFORCED METAL COMPOSITE MATERIAL

The present invention relates to a new process for producing a fiber-reinforced metal composite material (hereinafter referred to as "FRM"). More particularly, it relates to a process for producing FRM of fairly increased mechanical strength.

Recently, light-weight composite materials which comprise inorganic fibers such as alumina based fiber, carbon fiber, silica fiber, silicon-carbide fiber, boron fiber and a matrix such as aluminum or its alloy (hereinafter referred to as "aluminum alloy") have been developed and begun to be utilized in various kinds of industrial fields as mechanical parts which require especially good heat durability and high strength such as in the aerospace or car industry. However, FRM and the present methods of production have many drawbacks. For example, the solid phase method, such as diffusion bonding which combines a solid phase aluminum alloy and an inorganic fiber, can produce FRM of high strength. However, this method is hardly applicable to the industrial production of FRM because of its higher production cost based on the use of complex instruments and troublesome operations. FRM produced with the liquid phase method, which makes the composite from a molten aluminum alloy and an inorganic fiber, has an advantage of lower productive cost through its simpler operations but has unfavorable difficulties in that the molten aluminum alloy and the inorganic fiber react at their interface so as to decrease the strength of FRM to a level lower than is necessary for practical use.

In the case of some kinds of alloys as a matrix, the inorganic fiber is not so deteriorated when it is combined with a matrix; however, the mechanical strength of FRM produced thereby becomes remarkably inferior as compared with the strength which would be expected from the law of mixture. Hence, the said FRM is hardly applicable to practical use.

The present inventors have intensively studied on the reason why the mechanical strength of FRM becomes inferior, although inorganic fiber after the mixing with matrix alloy was not so deteriorated. Eventually, it has been found that mechanical strength of FRM is inferred to be influenced by the crystal structure of the matrix metal combined into FRM and, therefore, strength of FRM can be remarkably enhanced by controlling the crystal structure of the matrix metal.

A main object of the present invention is to provide an economical process for producing FRM of enhanced mechanical strength. Another object of the invention is to provide a process for producing FRM of enhanced mechanical strength by controlling the crystal structure of a matrix metal after mixing with an inorganic fiber. These and other objects and advantages of the invention will be apparent to those skilled in the art from the following descriptions.

It is well known that mechanical strength of metal itself can be improved by heat treatment. However, the present invention is characteristic in that heat treatment can be effected at such a high temperature (not lower than the solid phase line) at which a product formed merely from a matrix metal deforms and, therefore, can not be subjected to heat treatment.

That is, the present invention provides a process for producing a FRM of enhanced mechanical strength which comprises mixing an inorganic fiber with an aluminum alloy at a temperature of not lower than the melting point of said alloy to form a composite, (1) removing the composite from the mold at a temperature of not higher than the solid phase line of said alloy (i.e. a temperature at which liquid phase appears in said alloy), heating the composite to a temperature of more than the solid phase line, and holding the composite at the temperature (heat treatment) during a definite time (hereinafter, referred to as the "Indirect method"); or (2) without allowing the composite to cool to a temperature of not higher than the solid phase line (hereinafter, referred to as "Direct method"), quenching the composite rapidly to a temperature of 200° C. or lower from a temperature of more than the solid phase line but lower than the melting temperature.

The present invention will be illustrated in more detail hereinafter.

The inorganic fiber used in the present invention includes carbon fiber, silica fiber, silicon carbide fiber, boron fiber and alumina-based fiber. In this use, the inorganic fiber is required to have a high mechanical strength. It is desirable not to react excessively with molten aluminum alloy on the contact thereto. The reaction at the interface between the fiber and the molten alloy is desired to proceed to a proper degree. The mechanical strength is thereby not deteriorated, but the transfer of stress through the interface can be attained to realize a sufficiently reinforced effect. One of the procedures to realize this is to cover the surface of the inorganic fiber with any substance so as to control the wettability or reactivity at the interface between the fiber and the matrix metal. For these reasons, the most suitable inorganic fiber which exhibits the greatest effect of the present invention is a fiber of which the main component is alumina and the secondary component is silica (hereinafter referred to as "alumina based fiber") as disclosed in Japanese Patent Publication No. 13768/1976. Such alumina fiber is obtainable by admixing a polyaluminoxane having the structural units of the formula:

$$\begin{array}{c} -\mathrm{Al}-\mathrm{O}- \\ | \\ \mathrm{Y} \end{array}$$

wherein Y is at least one of an organic residue, a halogen atom and hydroxy group with at least one silicon-containing compound in such an amount that the silica content of the alumina fiber to be obtained becomes 28% or less, spinning the resultant mixture and subjecting the obtained precursor fiber to calcination. Particularly preferred is the alumina fiber which has a silica content of 2 to 25% by weight and which does not materially show the reflection of $\alpha$-$Al_2O_3$ in the x-ray structural analysis. The alumina fiber may contain one or more refractory compounds such as oxides of lithium, beryllium, boron, sodium, magnesium, silicon, phosphorus, potassium, calcium, titanium, chromium, manganese, yttrium, zirconium, lanthanum, tungsten and barium in such an amount that the effect of the invention is not substantially reduced.

The amount of the inorganic fiber used for FRM is not specifically restricted in so far as a strengthened effect is provided. By adopting a proper processing operation, the distribution of the fiber can be suitably controlled to ease infiltration of the molten matrix into the fiber bundles.

Preferable aluminum alloy used in the invention may be an alloy of which the main component is aluminum and the secondary component is copper, magnesium, silicon, or zinc. For the purpose of enhancing of the strength and fluidity and making a fine structure, one or more elements selected from silicon, iron, copper, manganese, magnesium, nickel, tin, zinc, zirconium, titanium, vanadium, sodium, lithium, antimony, strontium and chromium may be incorporated.

The method of this invention can be applied effectively to any process for improvement of the mechanical strength of FRM as disclosed in Japanese Patent Applications Nos. 105,729/1980, 106154/1980, 52616/1981, 52617/1981, 52618/1981, 52620/1981, 52621/1981, and 52623/1981, where one or more additive elements in the matrix other than described above such as bismuth, cadmium, indium, barium, radium, potassium, cesium, rubidium or francium are incorporated in alluminum alloys.

In order to make a composite material from an inorganic fiber and an aluminum alloy, various methods can be employed. However it is necessary to combine a fiber and an alloy under the condition that an aluminum alloy is in liquid phase. Thus, suitable methods employable are, for example, liquid-metal infiltration method (e.g. gas-pressurized infiltration method, vacuum infiltration method), squeeze casting method, low-pressure casting method and the like.

The present invention is characteristic in the following treatments:

(1) heat treatment of the composite is conducted at a temperature of not lower than the solid phase line followed by quenching (Indirect Method); or (2) quenching is conducted directly without allowing the composite to cool to a temperature of not higher than the solid phase line before the quenching (Direct Method).

The temperature of not lower than the solid phase line means a temperature at which a liquid phase appears in an aluminum alloy. For example, it is not less than 577° C. for aluminum alloys of Al-12%Si system, and not less than 548° C. for aluminum alloys of Al-5.0%Cu system.

The period of time necessary for the heat treatment in the Indirect Method varies depending upon the heat treatment temperature and the size of the product. Generally speaking, the heat treatment is conducted during 1 to 30 hours.

The quenching is conducted at a speed which is fast enough so as to not allow the segregation once diffused into the base alloy to reprecipitate in a coarse precipitant. In one embodiment, quenching can be conducted at a rate not slower than 300° C./min from the temperature of heat treatment to 200° C. As for the quenching method generally adopted, there are, for example some methods such as cooling in water or oil, immersing in liquid nitrogen or air-cooling. For the purpose of strain releasing, etc., a tempering operation after the quenching can be applied in so far as it does not damage the reinforcing effect of this invention. Realistically, it is desirable to conduct the tempering at a temperature of not less than 100° C. and not more than 250° C. for a period of not less than 5 hours and not more than 30 hours.

In heat treatment of the common aluminum alloys, the solid-solution treatment is carried out at a temperature lower than solid phase line. When heated above the solid phase line, it is difficult for said alloy to maintain its shape because a liquid phase appears in it. For example, the primary crystal of silicon present in the cast product of Al-12%Si alloy (SILUMIN), lowers the mechanical strength of the formed product. This primary crystal may not change even by solid-solution treatment at a temperature lower than the solid phase line, and, therefore, said aluminum alloy is considered a non-heat treatable alloy. But in the case of aluminum alloys reinforced with an inorganic fiber as in the present invention, since the alloys are reinforced with inorganic fibers, there is no change in the shape of the formed product of FRM even by the heat treatment at a temperature not lower than the solid phase line. Thus it becomes possible to carry out the heat treatment at a high temperature that has never been thought of for common aluminum alloys.

With the application of the heat treatment followed by quenching or with direct-quenching without allowing to cool the composite at a temperature of not higher than the solid phase line, not only the matrix alloy itself can be naturally strengthened through solid dissolving of segregation once existing at the interface of the grain boundary into the $\alpha$-phase, but also the mechanical strength of FRM can be enhanced by from several times to several tens the value which would be estimated from the strength enhancement of the matrix alloy itself. This is probably because some change or the like at the interface between the inorganic fiber and the matrix derived from the heat treatment and quenching or the direct quenching contributes to the enhancement of the mechanical strength of FRM.

The thus produced composite material of the invention shows a remarkably enhanced mechanical strength in comparison with the system wherein the treatment of the invention hereinabove is not employed.

The Direct Method of the invention is superior to the Indirect Method in terms of simplicity of the process and energy saving, because in the former, quenching is conducted directly from a high temperature after the combination of a fiber and a matrix without re-heating.

It is an extremely valuable merit of the invention in terms of commercial production that the processing of this FRM can be realized in a conventional system with the utilization of usual equipments without any alternation.

The present invention will be hereinafter illustrated in detail by the following examples which are not intended to limit the scope of the invention. Reference to % in the examples represents % by weight unless specified otherwise.

EXAMPLE 1 AND COMPARATIVE EXAMPLE 1

An alumina-based fiber [$Al_2O_3$ content, 85%; $SiO_2$ content, 15%; average fiber diameter, 14 $\mu$m; tensile strength, 150 kg/mm$^2$ (gauge length, 20 mm); modulus of elasticity, 23,500 kg/mm$^2$], was used as an inorganic fiber and was charged in a stainless steel molding tube so that the fiber volume content became 50%. Separately, aluminum alloys, SILUMIN (Al-12%Si) and AC-1A (Al-4.5%Cu), were each molten in a crucible placed in an autoclave. Thereafter, one end of said molding tube was immersed in the molten alloy and an argon gas pressure of 50 kg/cm$^2$ was applied onto the surface of the molten alloy while degassing at the other end thereof, whereby the molten alloy was infiltrated between fibers. The molding tube was then allowed to cool to obtain FRM.

Test pieces were prepared by cutting the formed product of FRM thus obtained and each was subjected to the heat treatment as shown in Table 1, and then the flexural strength thereof was measured. The results are shown in Table 1, which shows that the strength of FRM obtained by applying the heat treatment of the present invention is remarkably high.

TABLE 1

| Example No. | Matrix alloy | Heat treatment condition | Flexural strength (kg/mm²) |
|---|---|---|---|
| Example 1-1 | Al-12% Si | 580° C. × 8 hrs → water quenching | 100 |
| Comparative Example 1-1 | " | None | 43.3 |
| Comparative Example 1-2 | " | 515° C. × 8 hrs → water quenching (T4 treatment) | 52.6 |
| Comparative Example 1-3 | " | 515° C. × 8 hrs → water quenching → 180° C. × 12 hrs (T6 treatment) | 51.0 |
| Example 1-2 | Al-4.5% Cu | 650° C. × 8 hrs → water quenching | 87.4 |
| Example 1-3 | " | 550° C. × 8 hrs → water quenching | 75.2 |
| Comparative Example 1-4 | " | None | 54.9 |
| Comparative Example 1-5 | " | 480° C. × 8 hrs → water quenching (T4 treatment) | 58.2 |
| Comparative Example 1-6 | " | 480° C. × 8 hrs → water quenching → 160° C. × 12 hrs | 56.7 |

EXAMPLE 2 AND COMPARATIVE EXAMPLE 2

In these examples, a carbon fiber (average fiber diameter, 7.5 μm; tensile strength, 300 kg/mm²; modulus of elasticity, 23,000 kg/mm²) and a free carbon-containing silicon-carbide fiber (average fiber diameter, 15 μm; tensile strength, 220 kg/mm² modulus of elasticity, 20,000 kg/mm²) were used as inorganic fiber and ADC-12 (Al-3.5%Cu-12%Si) was used as aluminum alloy. An FRM having a fiber volume content of 50% was prepared in the same manner as described in Example 1. Test pieces were prepared by cutting the formed product of FRM thus obtained and each was subjected to the heat treatment as shown in Table 2, and then the flexural strength thereof was measured. The results are shown in Table 2, which shows that the strength of FRM obtained by applying the heat treatment of the present invention is high.

TABLE 2

| Example No. | Inorganic fiber | Heat treatment condition | Flexural strength (kg/mm²) |
|---|---|---|---|
| Example 2-1 | Carbon fiber | 560° C. × 8 hrs → water quenching | 44.7 |
| Example 2-2 | " | 560° C. × 8 hrs → water quenching → 180° C. × 12 hrs | 46.5 |
| Comparative Example 2-1 | " | None | 32.2 |
| Comparative Example 2-2 | " | 505° C. × 8 hrs → water quenching | 32.5 |
| Example 2-3 | Silicon-carbide fiber | 570° C. × 8 hrs → water quenching | 75.1 |
| Example 2-4 | Silicon-carbide fiber | 570° C. × 8 hrs → water quenching → 180° C. × 12 hrs | 76.3 |
| Comparative Example 2-3 | Silicon-carbide fiber | None | 40.8 |
| Comparative Example 2-4 | Silicon-carbide fiber | 515° C. × 8 hrs → water quenching | 42.2 |

EXAMPLE 3

An alumina-based fiber [$Al_2O_3$ content, 85%; $SiO_2$ content, 15%; average fiber diameter, 14 μm; tensile strength, 150 kg/mm² (gauge length, 20 mm); modulus of elasticity, 23,500 kg/mm²], was used as an inorganic fiber and was charged in a stainless steel molding tube so that the fiber volume content became 50%. Separately, aluminum alloys, AC-4C(Al-7%Si) and AC-1A(Al-4.5%Cu), were each molten in a crucible placed in an autoclave. Thereafter, one end of said molding tube was immersed in the molten alloy and an argon gas pressure of 50 kg/cm² was applied onto the surface of the molten alloy while degassing at the other end thereof, whereby the molten alloy was infiltrated between fibers. When the inner temperature dropped below the liquid phase line, the formed product was quickly taken out of the autoclave and quenched with water. During the procedure, 4 minutes was required while taking-out and quenching said product, the quenching rate was about 15° C./min in average, and the temperature of the composite just before the quenching was not less than the solid phase line. For comparison, another formed product was prepared in the same manner as above, cooled to 200° C. in 2 hours in the autoclave and then taken out of the autoclave. Test pieces were prepared by cutting the formed products thus obtained and the flexural strength thereof was measured. In the case of the final product obtained by quenching the flexural strength was 105 kg/mm² for AC-4C matrix, and 85.2 kg/mm² for AC-1A matrix. While that of the formed product obtained by slow cooling was 43.3 kg/mm² and 54.9 kg/mm², respectively. It can be seen from this result that the FRM produced by the present invention has a markedly high mechanical strength.

EXAMPLE 4

In this example, a carbon fiber (average fiber diameter, 7.5 μm; tensile strength, 300 kg/mm$^2$; modulus of elasticity, 23,000 kg/mm$^2$) and a free carbon-containing silicon-carbide fiber (average fiber diameter, 15 μm; tensile strength, 220 kg/mm$^2$; modulus of elasticity, 20,000 kg/mm$^2$) were used as inorganic fiber and ADC-5 (Al-7.0%Mg) was used as aluminum alloy.

The inorganic fiber was arranged in one direction and placed in a lower mold of 10 mm (thickness) × 50 mm (width) × 70 mm (length) in inside dimension. The mold was heated to 500° C. by a heater, and the molten alloy of ADC-5 heated to 800° C. was poured on the fiber and at the same time, a pressure of 1000 kg/cm$^2$ was applied thereto through the upper mold to mix the molten alloy with the inorganic fiber. After holding for 30 seconds in this state, the formed product was taken out of the mold and immersed in water for quenching. The temperature of the formed product when taken out of the mold was 600° C.

For comparison, a formed product (a slowly cooled product) was prepared by carrying out the forming the same manner as above, holding for 5 minutes under pressure in the mold and taking out.

Test pieces were prepared by cutting these formed products and the flexural strength thereof was measured. When the inorganic fiber is a carbon fiber, the flexural strength of the formed products obtained by quenching and cooling slowly was 53.8 kg/mm$^2$ and 40.7 kg/mm$^2$, respectively. When the inorganic fiber is a silicon-carbide fiber, that of both the products was 68.1 kg/mm$^2$ and 42.3 kg/mm$^2$. respectively. In both cases, the FRM produced by the present invention had a higher mechanical strength.

EXAMPLE 5

In this example, a boron fiber [average fiber diameter, 100 μm; tensile strength, 350 kg/mm$^2$ (gauge length, 2.0 mm); modulus of elasticity, 42,000 kg/mm$^2$] and a silica fiber [average fiber diameter, 7 μm; tensile strength, 600 kg/mm$^2$ (gauge length, 20 mm); modulus of elasticity, 7,400 kg/mm$^2$] were used as inorganic fiber, and 7076 alloy (Al-7.5%Zn-1.6%Mg-0.6%Cu-0.5%Mn) was used as aluminum alloy.

The inorganic fiber was arranged in one direction and placed in a lower mold of 10 mm (thickness) × 50 mm (width) × 70 mm (length) in inside dimension so that the fiber volume content became 40%. The mold was heated to 400° C. by a heater, and the molten alloy of 7076 alloy heated to 800° C. was poured on the fiber and at the same time, a pressure of 1000 kg/mm$^2$ was applied thereto through the upper mold to mix the molten alloy with the inorganic fiber. The formed composite product was cooled to 400° C. within the mold and then taken out from the mold. Half of the product was then used for the measurement of flexural strength as obtained. The remaining half of the product was subjected to the heat treatment at 600° C. for 3 hours in a heating furnace, followed by quenching with water, and the resulting product was used for the measurement of flexural strength. The results are shown in Table 3. As is clear from Table 3, the product obtained by subjecting to the heat treatment showed higher strength.

TABLE 3

| Fiber | Flexural strength (kg/mm$^2$) Heat-treated | Not heat-treated |
|---|---|---|
| Boron fiber | 80.1 | 62.6 |
| Silica fiber | 46.5 | 31.4 |

The invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A process for producing a fiber-reinforced metal composite material which comprises mixing an inorganic fiber with an aluminum alloy at a temperature of not lower than the melting point of said aluminum alloy to form a composite;

removing the composite from a mold at a temperature of not higher than the solid phase line of said aluminum alloy and heating the composite to a temperature of more than the solid phase line and holding the temperature during a definite time; and quenching the composite to a temperature of 200° C. or lower from a temperature of higher than the solid phase line but lower than the melting temperature.

2. A process according to claim 1, wherein the inorganic fiber is alumina-based fiber, carbon fiber, silicon carbide fiber, silica fiber or boron fiber.

3. A process according to claim 2, wherein the alumina-based fiber comprises alumina as the main component and silica as the second component.

4. A process according to claim 3, wherein the alumina-based fiber comprises not more than 28% by weight of silica.

5. A process according to claim 4, wherein the alumina-based fiber comprises 2 to 25% by weight of silica.

6. A process according to claim 3, wherein the alumina-based fiber does substantially not show the reflection of α-alumina.

7. A process according to claim 1, wherein the aluminum alloy contains a metal selected from the group consisting of copper, magnesium, silicon, and zinc as the secondary component.

8. A process according to claim 1, wherein the heat treatment is conducted for 1 to 30 hours.

9. A process according to claim 1, wherein the quenching is conducted by cooling the treated composite at a rate of 300° C./min or more from a temperature of not lower than the solid phase line to 200° C.

10. A fiber-reinforced metal composite produced by the process of claim 1.

11. A fiber-reinforced metal composite produced by the process of claim 2.

12. A fiber-reinforced metal composite produced by the process of claim 4.

13. A fiber-reinforced metal composite produced by the process of claim 7.

14. A fiber-reinforced metal composite produced by the process of claim 9.

15. A process for producing a fiber-reinforcing metal composite material which comprises mixing silica fiber with an aluminum alloy at a temperature of not lower than the melting point of said aluminum alloy to form a composite;

removing the composite from a mold at a temperature of not higher than the solid phase line of said aluminum alloy and heating the composite to a temperature of more than the solid phase line and holding the temperature during a definite period of time; and quenching the composite to a temperature of 200° C. or lower from a temperature of higher than the solid phase line but lower than the melting temperature.

16. A fiber-reinforced metal composite produced by the process of claim 15.

* * * * *